US005834299A

United States Patent [19]

Andersen

[11] Patent Number: 5,834,299

[45] Date of Patent: Nov. 10, 1998

[54] METHOD FOR DEHAIRING OF HIDES OR SKINS BY MEANS OF ENZYMES

[75] Inventor: Lars Peter Andersen, Klampenborg, Denmark

[73] Assignee: Novo Nordisk A/S, Bagsuaerd, Denmark

[21] Appl. No.: 878,910

[22] PCT Filed: Dec. 20, 1995

[86] PCT No.: PCT/DK95/00509

§ 371 Date: Jun. 19, 1997

§ 102(e) Date: Jun. 19, 1997

[87] PCT Pub. No.: WO96/19590

PCT Pub. Date: Jun. 27, 1996

[30] Foreign Application Priority Data

Dec. 21, 1994 [DK] Denmark ..... 1456/94

[51] Int. Cl.[6] ..... C14C 1/00

[52] U.S. Cl. ..... 435/265; 8/94.18

[58] Field of Search ..... 8/94.1 R, 94.18; 435/265, 267

[56] References Cited

U.S. PATENT DOCUMENTS

| | | | |
|---|---|---|---|
| 3,480,433 | 11/1969 | Haist et al. | 96/49 |
| 3,986,926 | 10/1976 | Monsheimer et al. | 435/265 |
| 4,960,428 | 10/1990 | Christner et al. | 8/94.18 |

FOREIGN PATENT DOCUMENTS

| | | | |
|---|---|---|---|
| 2 047 738 A | 12/1980 | United Kingdom | 435/265 |
| WO 9406942 | 3/1994 | WIPO | C14C 1/06 |
| WO 9500636 | 1/1995 | WIPO | C12N 9/90 |
| WO 9501425 | 1/1995 | WIPO | C12N 9/06 |

*Primary Examiner*—David A. Redding
*Attorney, Agent, or Firm*—Steve T. Zelson; Cheryl Agris

[57] ABSTRACT

The invention relates to an environmentally friendly method for dehairing of hides or skins by means of enzymes comprising the following steps: 1) the hides or skins are soaked, 2) the soaked hides or skins are subjected to a main soak, and 3) the thus treated hides or skins are dehaired by addition of water, exposure to mechanical influence and subjection to at least one protease, characterized in that the hides or skins are subjected to at least one protein disulfide redox agent at least one time during step 1) to 3).

28 Claims, No Drawings

METHOD FOR DEHAIRING OF HIDES OR SKINS BY MEANS OF ENZYMES

CROSS-REFERENCE TO RELATED APPLICATIONS

This application is a 35 U.S.C. 371 national application of PCT/DK95/00509 filed Dec. 20, 1995 and claims priority under 35 U.S.C. 119 of Danish application 1456/94 filed Dec. 21, 1994, the contents of which are fully incorporated herein by reference.

FIELD OF THE INVENTION

The invention relates to a method for dehairing of hides or skins by means of enzymes.

BACKGROUND OF THE INVENTION

The dehairing of hides or skins assisted by means of enzymes was first described around mid- to late 1960's. A typical representative prior art method is described in U.S. Pat. No. 3,840,433 (Aunstrup et al.), which describes dehairing of skins and hides in a strongly alkaline environment by means of certain alkali resistant proteolytic enzymes.

A drawback in relation to methods for dehairing of this kind is the fact that no perfect dehairing can be obtained, because the resulting dehaired hide or skin will either be incompletely dehaired (if the amount of enzyme used is small) or be damaged in the grain (if the amount of enzyme is high).

Another prior art method of this type is described in PCT/DK93/00283. Even if it is possible to obtain a complete dehairing without damaged grain with this prior art method, it uses sulfide and thus is not environmentally friendly.

Hitherto it has not been possible in an environmentally friendly way to produce a completely dehaired hide or skin with undamaged grain by the use of enzymes.

SUMMARY OF THE INVENTION

It is the purpose of the present invention to solve some of the above mentioned problems by providing an environmentally friendly method for dehairing hides or skins by means of enzymes, which will result in a hide or skin which is completely dehaired, and which exhibits an undamaged grain.

Surprisingly it has now been found that hides or skins can be dehaired completely without damaging the grain thereof by means of an environmentally friendly method.

According to the invention the method for dehairing of hides or skins comprises the following steps:

1) the hides or skins are soaked,
2) the soaked hides or skins are subjected to a main soak, and
3) the thus treated hides or skins are dehaired by addition of water, exposure to mechanical influence and subjection to at least one protease, characterized in, that the hides or skins are subjected to at least one protein disulfide redox agent at least one time during step 1) to 3).

DETAILED DESCRIPTION OF THE INVENTION

The present inventors have surprisingly succeeded in finding an environmentally friendly method for dehairing hides or skins by means of enzymes, which results in completely dehaired hides or skins with an undamaged grain.

The method can advantageously be used for dehairing skins or hides from bovine and also hides or skins from other provenance, e.g. sheep or goat.

According to the method of the invention the hides or skins 1) are soaked,
2) the soaked hides or skins are subjected to a main soak, and
3) the thus treated hides or skins are dehaired by addition of water, exposure to mechanical influence, and subjection to at least one protease, characterized in, that the hides or skins are subjected to at least one protein disulfide redox agent at least one time during step 1) to 3).

The steps 1), 2) and 3) are usually performed in the same equipment, such as a beam house drum, which ensures that the skins and hides are subjected to sufficient mechanical influence. However, the steps may be carried out in different pieces of equipment.

In which of step 1), 2) or 3) the protein disulfide redox agent in question is added, depends on the pH-optimum of said protein disulfide redox agent in relation to the pH of the process.

At pH-optimum the enzyme in question exhibits about 80 to 100% of maximum catalytic activity.

If the protein disulfide redox agent has a pH-optimum about 7, it is preferred that it is added during the main soak in step 2) , as the main soak normally is carried out at pH 7 to 9.

If the protein disulfide redox agent has a pH-optimum at a significantly higher pH (high alkaline protein disulfide redox agents) it may be advantageous to add it together with the protease in step 3). This leads to degradation of keratin immediately after the removal of disulfide cross bonds.

High alkaline protein disulfide redox agents are enzymes showing optimal enzyme activity at pH above 9, preferable in the range of pH used for the dehairing (step 3)), i.e. between pH 9 and 13, in most cases between 10 and 12.5.

In certain cases it is advantageous to add said protein redox agent during the initial soak (step 1)) or the main soak (step 2)), and in other cases simultaneously with or in arbitrary sequence with said protease in step 3).

It is also contemplated according to the invention to add a protein disulfide redox agent during the main soak and further simultaneously with or in arbitrary sequence with said protease. The added protein disulfide redox agent(s) may be the same or two different protein disulfide redox agents.

It is to be understood, that if the two enzymes, the protein disulfide redox agent and the protease, respectively, exhibit pH optima, which are too different, they will have to be added sequentially and with pH adjustment.

The initial soak is performed to remove dirt, blood and other impurities from the hides or skins. In industrial practice the hides or skins will always need the initial soak. If however the hides or skins have already been cleaned, the first step is less important and in some cases not even necessary.

The initial soak and the main soak are in general performed in water.

According to the invention chemicals, which are conventionally used during the soaking and dehairing steps, can be used,. and usually advantageously can be used in the method according to the invention as well, e.g. preservation agents, detergents and soda during soaking, and lime during dehairing.

A soaking enzyme is often added during the main soak in step 2) to soften the hides and skins. For soaking, broadspectrum proteases, such as Aquaderm™ (available from Novo Nordisk A/S), can be used. However, if the skins or hides are of poor quality soaking enzymes must be used with caution.

A possible explanation for the surprising effect, obtained by the method of the present invention, is that the protein disulfide redox agent prepares the hair roots for the protease treatment. The preparation of the hair roots causes removal of some of the disulfide cross bonds in the soft keratin (having only few disulfide cross bonds) leading to an even softer keratin, similar to the keratin type present in the epidermis. The treatment with protease degrades both the epidermis and the hair roots resulting in a complete dehairing of the hides and skins.

Said protein disulfide redox agents catalyses the general reaction:

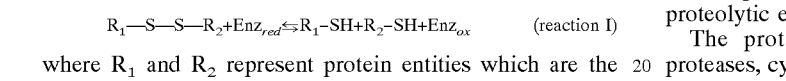

$$R_1—S—S—R_2+Enz_{red} \leftrightarrows R_1-SH+R_2-SH+Enz_{ox} \quad \text{(reaction I)}$$

where $R_1$ and $R_2$ represent protein entities which are the same or different, either within the same polypeptide or in two polypeptides, $Enz_{ox}$ is a protein disulfide redox agent in the oxidised state, and $Enz_{red}$ is a protein disulfide redox agent in the reduced state. The group EC 5.3.4.1 (Enzyme Nomenclature, Academic Press, Inc., 1992) refers to enzymes capable of catalysing the rearrangement of —S—S— bonds in proteins and the groups E 1.6.4.4 and E 1.8.4.2 are examples of enzymes catalysing the reaction with NA(P)H and glutathione as a mediator, respectively.

According to the invention all protein disulfide redox agents, and mixtures thereof, can be used. Examples of such include protein disulfide redox agents selected from the group comprising protein disulfide reductases, protein disulfide isomerases, protein disulfide oxidases, protein disulfide oxidoreductase, protein disulfide transhydrogenases, sulfhydryl oxidase, and thioredoxins, including protein disulfide redox agents according to the pending patent applications WO 94/00264 and WO 94/00265 (Novo Nordisk A/S).

Preferred protein disulfide redox agents are protein disulfide isomerases (PDI), thioredoxins (TRX), or disulfide bond formation proteins, such as DsbA and DsbC, or variants thereof.

TRX is a 12 kDa protein having a redox-active disulfide/dithiol and catalysing thial-disulfide exchange reactions (Edman et al., (1985), Nature, 317, p. 267–270; Holmgren, (1985), Annu. Rev. Biochem., 54, p. 237–271; Holmgren, (1989), J. Biol. Chem., 264, p. 13963–13966).

PDI is a 57 KDa protein which normaly consists of two subunits. It has a redox-active disulfide/dithiol and catalysing thiol-disulfide exchange reactions (acting as a disulfide oxidase and isomerase) (Yamauchi et al., (1987), Biochem. Biophys. Res. Commun., 146, p. 1485–1492), Chicken (Parkkonen et al.,, (1988), Biochem. J. 256, p. 1005–1011), Human (Rapilajaniemi et al., (1987), EMBO J., 6, p. 643–649), Mouse (Gong, et al., (1988), Nucleic Acids Res., 16, p. 1203), Rabbit (Fliegel et al., (1990), J. Biol. Chem., 265, p. 15496–15502), and Rat (Edman et al., (1985), Nature, 317, p. 267–270). PDI has furthermore been isolated from yeast (Tachikawa et al., J. Biochem., 110, p. 306–313).

DsbA is a 21 kDa protein known to be capable of reducing disulfide bonds of insulin and activity common to disulfide oxidoreductases (Bardwell et al., (1991), Cell, Vol. 67, p. 581–589).

DsbC is a 23 kDa protein known to exhibit disulfide oxidase and disulfide isomerase activity (Missiakas et al., (1994), The EMBO journal, vol. 13, no. 8, p. 2012–2020).

It is to be understood that a redox partner should also be present together with the protein disulfide redox agent. This redox partner exhibits an effect on the protein disulfide redox agent, not on the hides or skins. According to the method of the invention all redox partners can be used.

Said redox partner may be an organic or inorganic reductant selected from the group comprising glutathione, L-cysteine, dithiothreitol (DTT), 2-mercaptoethanol, thioglycolic acid, L-cysteine ethylester, β-mercaptoethylamine, mercaptosuccinic acid, β-mercaptopropionic acid, dimercapto adipic acid, thiomalic acid, thioglycoamides, glycol thioglycolate, glycerol thioglycolate, thiolactic acid and salts thereof, sulfite and bisulfite.

However, weak redox partners such as glutathione and dithiotreitol (DTT) are preferred. Even the dehairing float itself exhibits weak redox potential.

In regard to the step 3) it should be noted that any proteolytic enzyme or mixtures thereof may be used.

The protease may be a serine proteases, aspartic proteases, cysteine proteases and metallo proteases, respectively. As suitable enzymes are also contemplated truncations, mutations and/or variants of the above listed groups of enzymes.

Examples of serine proteases are e.g. trypsins, chymotrypsins and subtilisins.

Preferred are the Bacillus sp. derived alkaline serine proteases. It has been found experimentally that an enzyme of this kind gives rise to a satisfactory dehairing without grain damage. Examples of such are subtilisin BPN', subtilisin amylosacchariticus, subtilisin 168, subtilisin mesentericopeptidase, subtilisin carlsberg, subtilisin DY, subtilisin 309, subtilisin 147, thermitase, aqualysin, Bacillus PB92 protease, proteinase K, Protease TW7, and Protease TW3, truncations, mutations and variants thereof.

In the context of this invention a subtilisin variant or mutated subtilisin protease means a subtilisin that has been produced by an organism which is expressing a mutant gene derived from a parent microorganism which possessed an original or parent gene and which produced a corresponding parent enzyme, the parent gene having been mutated in order to produce the mutant gene from which said mutated subtilisin protease is produced when expressed in a suitable host.

References to such enzymes and/or methods for producing truncations, variants, and mutations include EP 130,756 (Genentech), EP 479,870 (Novo Nordisk A/S), EP 214,435 (Henkel), WO 87/04461 (Amgen), WO 87/05050 (Genex), EP application no. 87303761 (Genetech), EP 260,105 (Genecor), WO 88/06624 (GistBrocades NV), WO 88/07578 (Genentech), WO 88/08028 (Genex), WO 88/08033 (Amgen), WO 88/08164 (Genex), Thomas et al., (1985), Nature, 318, p. 375–376; Thomas et al., (1987), J. Mol. Biol., 193, p. 803–813; Russel and Fersht, (1987), Nature 328, p. 496–500. Other methods well established in the art may also be used.

Examples of cysteine proteases are e.g. papain and bromelain.

To the group of metallo proteases are e.g. Neutrase® (available from Novo Nordisk A/S) and collagenase.

Examples of acidic aspartic proteases are e.g. pepsin A, pepsin B, pepsin C, chymosin, cathepsin B and renin.

The activity of the above mentioned proteases may in general be determined as described in "Methods of Enzymatic Analysis", Third Edition, vol. 5, (1984), Verlag Chemie, Weinheim.

Preferred examples of enzymes, which may be used according to the invention, comprises alkaline proteases as described in WO 92/17576, WO 89/06279, Wo 91/00345, and PCT/DK93/00074.

A specific example of a suitable readily available protease is NUE (from Novo Nordisk A/S).

In a preferred embodiment of the method according to the invention the protease exhibits a pH activity curve with a maximum above pH 9, according to the KNPU activity determination method (the KNPU activity determination method which uses casein as a substrate is described in AF 277, which is available on request from Novo Nordisk A/S, Novo Alle, DK-2880 Bagsvaerd, Denmark). In. this manner a very satisfactory removal of the hair is obtained without grain damage.

An embodiment of the method according to the invention comprises that green fleshing is carried out between step 2) and 3). The green fleshing is performed to remove fat which may interfere with the dehairing. In this embodiment the following advantages are obtained: 1) the enzymatic action during the dehairing is improved due to the reduced amount of fat in the dehairing float and on the hides or skins, and 2) the sewage water contains less fat and is thus more acceptable from an environmental point of view.

However, it is also contemplated according to the invention to perform a fleshing after the dehairing step, instead of said green fleshing.

In step 3) the water is added in an amount which provides satisfactory rubbing between the individual hides or skins, and the mechanical influence are usually ensured by drumming the skin and hides e.g. in a bean house drummer or the like.

In a preferred embodiment of the method according to the invention the water is added in an amount between 50 and 200% in relation to the dry weight of the hides or skins, preferably between 70 and 120% thereof. With an amount of water less than 50% the abrasion of the hides or skins may be damaging, and with an amount of water above 200% the mechanical impact usually is too low, and also, the consumption of water will be undesirably high.

The temperature interval for performing the method according to the invention is chosen in consideration of the optimal activity of the enzymes and e.g. the shrink properties of the hides or skins. A suitable temperature interval is from 5° C. to 60° C., preferably from 10° C. to 40° C., especially from 22° C. to 32° C.

In an embodiment of the invention the protein disulfide redox agent, the redox partner and the protease are added simultaneously in step 3). In this case the two enzymes should exhibit approximately the same pH optimum. Thus, this embodiment is simple, because the enzyme addition is carried out as a one step process.

A preferred embodiment of the method according to the invention comprises that in step 3) the protein disulfide redox agent and the protease are added sequentially in such manner that the protein disulfide redox agent is added first, and subsequently the protease.

It has been found that a very effective dehairing together with a perfect grain can be obtained, because a protease with a high pH optimum can be used in this case, such proteases usually being the best dehairing enzymes.

A preferred embodiment of the method according to the invention comprises that the protein disulfide redox agent is added in an amount of between 25 and 1000 mg of pure enzyme protein/kg of salted hide or skin and the protease is added in an amount of between 5 and 50 mg of pure enzyme protein/kg of salted hide or skin, and that the total dehairing time is maximum 24 hours. It has been found that the desired result can be obtained with the activities and times indicated. With enzymes in less amounts and with shorter times less satisfactory result can be obtained. With enzymes in greater amounts and with longer times the method will be uneconomic and/or the grain may be damaged.

A preferred embodiment of the method according to the invention comprises that the hairs are removed from the dehairing liquor by continuous filtration during the dehairing. If no continuous filtration is carried out the hairs will tend to adhere to the fatty tissue on the back of the hide or skin.

The method according to the invention will be illustrated by the following examples.

The dehairing effect is caused by decomposition of the epidermis keratin. Thus, if a heavier decomposition of the epidermis keratin can be demonstrated, a better dehairing effect is simultaneously demonstrated.

Although the present invention is illustrated in the following examples, many alterations and modifications are possible in practice of this invention without departing from the spirit or scope thereof. Accordingly, the scope of the invention is to be construed in accordance with the substance defined by the following claims.

METHODS AND MATERIALS

Substrate

Keratin azure, Sigma K-8500, LOT 33H3614 (a partially denatured blue dyed keratin)

Enzymes 5 mg PDI dissolved in 1.5 ml 0.1 M $K_2HPO_4$ (produced as described in WO 94/00264 and available from Novo Nordisk A/S).

NUE 12.0 MP (Activity 8.37 KNPU(E)/g) (available from Novo Nordisk A/S).

Eusapon-S (detergent)

Arazit KF (preservation agent)

Redox partner

Dithiotreitol (DTT)

Buffer 0.1M $K_2HPO_4$ (pH 7.0)

Methods

Determination of NUE protease activity

KNPU activity determination is done as described in AF-277 (available on request from Novo Nordisk A/S).

Determination of PDI activity

Insulin from Novo Nordisk A/S is used as substrate. Insulin, which contains two disulfide bonds (—S—S—), becomes turbid when the disulfide bonds are removed. This can be determined spectrophotometric at 650 nm.

Insulin (sparingly soluble) is suspended in water and 0.1M HCl is added until the insulin is dissolved.

Using weak NaOH the solution is titrated until turbidity and one drop of HCl is added. Water is added until the insulin concentration is 1.3 mM.

Substrate before use

100 μl 1 M $K_2HP0_{41}$ pH 7

100 μl 1.3 mM insulin 3.3 μl 100 mM DTT

800 μl water 5 mg PDI in 1.5 ml buffer, pH 7.0, is diluted with 100 Al 0.1 M sodium-phosphate and 263 μl 1 mM EDTA, pH 7.0, to approximately 100 U/ml.

0-10-20-40-60-80-100 μl PDI is filled into micro titter plates and buffer is added to 100 μl. 100 μl insulin substrate is added. As a measure of the enzyme activity the absorbance is monitored at 650 nm.

EXAMPLES

Example 1

20 mg of keratin azure is introduced into a small vessel with lid. To the keratin azure is added 10 ml of 0.1 M $K_2HP0_4$ (pH 7.0) and varying amounts of 100 mM DTT. A small magnetic stirrer is introduced into the vessel.

Subsequently varying amounts of PDI (protein disulfide redox agent) as appears from the below indicated table, are added, and the mixture is heated to 60° C. and subjected to magnetic stirring for 19 hours. Then the temperature is lowered to 30° C., and varying amounts of NUE protease are added, and the mixture is agitated for 52 hours.

Subsequently the liquids are filtered, and the colour development is measured spectrophotometrically at 595 nm. The higher the absorption, the more the keratin azure is decomposed.

TABLE 1

| | Step 1 | | | |
|---|---|---|---|---|
| Sample No. | mg PDI per vessel (20 mg keratin azure) | μl DTT per vessel (20 mg keratin azure) | Step 2 gram pure NUE protease per g keratin azure | Absorbance at 595 nm |
| 1 | 0.25 | 5 | $200 \times 10^{-5}$ | 0.664 |
| 2 | 0.50 | 5 | $200 \times 10^{-5}$ | 0.838 |
| 3 | 1.50 | 5 | $200 \times 10^{-5}$ | 0.998 |
| 4 | 0.25 | 5 | $200 \times 10^{-5}$ | 0.585 |
| 5 | 0 | 5 | $200 \times 10^{-5}$ | 0.270 |
| 6 | 0 | 5 | 0 | 0.137 |
| 7 | 0 | 100 | 0 | 0.257 |

The experiment indicates that a protease (NUE) alone, and further a redox partner (DTT) alone, does not significantly decompose hair (keratin azure), while the combination of a protease and a protein disulfide redox agent, in the presence of a redox partner, decompose hair proportionally with increasing amount of protein disulfide redox agent.

Example 2

50 kg bovine hides was dehaired using PDI enzyme as protein disulfide redox agent, DTT as the redox partner, and NUE as the protease.

Initial soak—step 1)

0 h 300% (150 kg) of water with a temperature of approximately 25° C.
0.1% of Eusapon-S (0.05 kg) (detergent)
Start—10 rpm (rounds per minute)
The pH was in the range of between 7 and 8.

0:30 h Stop

Main soak—step 2)

0:45 h 125% (67.5 kg) of water with a temperature of approximately 280C.
1) 0.1% Eusapon-S (0.05 kg)(detergent)
2) 0.01% Arazit KF (0.005 kg) (preservation agent)
3) 0.003% Aquaderm™ B (0.0015 kg) (soaking enzyme)
4) 0.1% PDI-product (0.050 kg) 10 mg active PDI-protein/gram PDI-product.
10 rpm (rounds per minute)
The pH was in the range between 7 and 8.

5:45 h Stop

Dehairing—step 3)

6:00 h 80% (40 kg) of water with a temperature of approximately 28° C.
2.5% lime (1.25 kg)

6:15 h 0.06% NUE (0.03 kg) 12,0 MP (protease)

11:00 h Operation of drum set to 5 minutes of operation followed by 25 minutes break 24:00 h stop Fleshing was performed after the dehairing step.

The bovine hides are fully dehaired and had an undamaged grain.

Conclusion

The above experiments shows that skins and hides can be dehaired in an environmentally friendly way (without sulfide) by means of a protein disulfide redox agent.

The above examples are model experiments. It has been found, however, that hides or skins dehaired by means of the method according to the invention are completely dehaired without any grain damage whatsoever.

I claim:

1. A method for dehairing of hides or skins by means of enzymes, wherein 1) the hides or skins are soaked
2) the soaked hides or skins are subjected to a main soak, and
3) the thus treated hides or skins are dehaired by addition of water, exposure to mechanical influence and subjection to at least one protease, characterized in that the hides or skins are subjected to at least one protein disulfide redox agent at least one time during step 1) to 3).

2. The method according to claim 1, wherein said protein redox agent is added during the main soak in step 2).

3. The method according to claim 1, wherein said protein redox agent is added simultaneously with or in arbitrary sequence with said protease.

4. The method according to claim 1, wherein a protein redox agent is added during the main soak and a protein disulfide redox agent is added simultaneously with or in arbitrary sequence with said protease.

5. The method according to claim 4, wherein the first added protein disulfide redox agents are the same as the secondly added protein disulfide redox agent.

6. The method according to claim 4, wherein the first protein disulfide redox agents is different from the secondly added protein disulfide redox agent.

7. The method according to claim 3 wherein the protein disulfide redox agent and the protease are added simultaneously.

8. The method according to claim 3, wherein the protein disulfide redox agent and the protease are added sequentially in such manner that the protein disulfide redox agent is added first, and subsequently the protease.

9. The method according to claim 1, wherein the protein disulfide redox agent may be added during step 1), 2) or 3).

10. The method according to any of claim 1, wherein a soaking enzyme is added during the main soak in step 2).

11. The method according to any of claim 1, wherein a green fleshing is carried out between step 2) and 3).

12. The method according to any of claim 1, wherein the amount of water added to the treated hides or skins in step 3) is between 50 and 200% in relation to the dry weight of the hides or skins, preferably between 70 and 120% thereof.

13. The method according to claim 1, wherein the protein disulfide redox agent is added in an amount of between 25 and 1000 mg of pure enzyme protein/kg of salted hide or skin and the protease is added in an amount of between 5 and 50 mg of pure enzyme protein/kg of salted hide or skin, and that the total dehairing time is maximum 24 hours.

14. The method according to claim 1, wherein the protein disulfide redox agent is selected from the group of compounds comprising protein disulfide reductases, protein disulfide isomerases, protein disulfide oxidases, protein disulfide oxidoreductase, protein disulfide transhydrogenases, sulfhydryl oxidase, thioredoxins and disulfide bond formation proteins.

15. The method according to claim 14, wherein the protein disulfide redox agent is a protein disulfide isomerase (PDI), or variants thereof.

16. The method according to claim 14, wherein the protein disulfide redox agent is a thioredoxin (TXR), or variants thereof.

17. The method according to claim 14, wherein the protein disulfide redox agent is a disulfide bond formation protein, or variants thereof.

18. The method according to claim 17, wherein the protein disulfide redox agent is DsbA.

19. The method according to claim 17, wherein the protein disulfide redox agent is DsbC.

20. The method according to any of claim 1, wherein the protease is selected from the group of serine proteases, aspartic proteases, cysteine proteases and metallo proteases, or truncation, mutations or variants of thereof.

21. The method according to claim 20, wherein the protease is 25 a serine proteases, including trypsins, chymotrypsins and subtilisins.

22. The method according to any of claim 20, wherein the protease is a Bacillus sp. derived alkaline serine proteases.

23. The method according to claim 22, wherein the protease exhibits a pH activity curve with a maximum above pH 9, according to the KNPU activity determination method.

24. The method according to claims 21 or 23, wherein the protease is selected from the group comprising subtilisin BPN', subtilisin amylosacchariticus, subtilisin 168, subtilisin mesentericopeptidase, subtilisin Carlsberg, subtilisin DY, subtilisin 309, subtilisin 147, thermitase, aqualysin, Bacillus PB92 protease, proteinase K, Protease TW7, and Protease TW3, truncations, mutations and variants thereof.

25. The method according to claim 20, wherein the cysteine protease is from the group including papain and bromelain.

26. The method according to claim 20, wherein the metallo protease is from the group comprising Neutrase® and collagenase.

27. The method according to claim 20, wherein the aspartic protease is selected from the group comprising pepsin A, pepsin B, pepsin C, chymosin, cathepsin B and renin.

28. The method according to claim 1, wherein the hairs are removed from the dehairing liquor by continuous filtration during the dehairing.

* * * * *

UNITED STATES PATENT AND TRADEMARK OFFICE

CERTIFICATE OF CORRECTION

PATENT NO. : 5,834,299

DATED : November 10, 1998

INVENTOR(S) : Lars Peter Andersen

It is certified that error appears in the above-indentified patent and that said Letters Patent is hereby corrected as shown below:

Col. 10, line 6, claim 21, delete "is 25 a serine" and insert --is a serine--.
Col. 10, line 14, claim 24, delete "claim 21 or 23" and insert --claim 21--.

Signed and Sealed this

Tenth Day of April, 2001

*Attest:*

Nicholas P. Godici

NICHOLAS P. GODICI

*Attesting Officer*

*Acting Director of the United States Patent and Trademark Office*